US006166485A

United States Patent [19]

Kroon et al.

[11] Patent Number: 6,166,485

[45] Date of Patent: Dec. 26, 2000

[54] ELECTRON GUN WITH HEAT DISSIPATION ELEMENTS

[75] Inventors: Ron Kroon; Maarten H. Zonneveld; Edwin Heijman; Arnold Sinke, all of Eindhoven, Netherlands

[73] Assignee: U.S. Philips Corporation, New York, N.Y.

[21] Appl. No.: 09/088,721

[22] Filed: Jun. 1, 1998

[30] Foreign Application Priority Data

Jun. 3, 1997 [EP] European Pat. Off. ..... 97201660

[51] Int. Cl.[7] ..... H01J 29/46

[52] U.S. Cl. ..... 313/446; 313/447; 313/456; 313/270

[58] Field of Search ..... 313/446, 447, 313/456, 270

[56] References Cited

U.S. PATENT DOCUMENTS

| | | | |
|---|---|---|---|
| 4,853,584 | 8/1989 | Inoue | 313/447 |
| 5,027,029 | 6/1991 | Higuch et al. | 313/446 |
| 5,424,606 | 6/1995 | Karasawa et al. | 313/446 |

FOREIGN PATENT DOCUMENTS

| | | | |
|---|---|---|---|
| 19537229 | 1/1997 | Germany | H01J 37/06 |
| 63-58728A | 3/1988 | Japan | H01J 9/14 |

*Primary Examiner*—Vip Patel
*Attorney, Agent, or Firm*—Robert J. Kraus

[57] ABSTRACT

Picture display device comprising an electron gun with cathodes having an enhanced dissipation of heat by virtue of an enlarged surface or an increase of the emissivity of the surface.

6 Claims, 3 Drawing Sheets

ELECTRON GUN WITH HEAT DISSIPATION ELEMENTS

BACKGROUND OF THE INVENTION

1. Field of the Invention

The invention relates to a picture display device comprising a cathode ray tube with a tube base, which cathode ray tube comprises an electron gun with a cathode and electrostatic grids which are connected to glass rods. The invention also relates to a cathode ray tube comprising an electron gun with a cathode. Moreover, the invention relates to an electron gun provided with a cathode. This type of picture display device may comprise a conventional cathode ray tube or a flat-panel cathode ray tube.

2. Description of Related Art

A cathode ray tube for a monochrome picture display device, for example a television or monitor, has a display screen with a regular pattern of phosphor elements constituting pixels. The cathode ray tube also comprises an electron gun with a cathode, which electron gun emits an electron beam during operation. This beam may be sent to a given location on the display screen by means of deflection coils which generate a given electric field. The display screen is now activated by sweeping the electron beam along it, while the beam is modulated by a video signal. This video signal ensures that the phosphor elements are excited in such a way that their luminescence produces an image. When many electrons land on the element during the period of excitation, the element lights up to a brighter extent. There are many elements per surface unit. Moreover, the elements are excited one after the other within a very short time. The viewer thus experiences a moving image at a normal viewing distance. In a color display device, for example a color television or a color monitor, each pixel comprises three phosphor elements each luminescing in a different primary color when they are excited. There are, as it were, three uniform regular patterns on the display screen, each pattern having a different color. Instead of one electron beam, three electron beams from three different cathodes in the electron gun are swept along the screen during operation. Each of these three beams excites the pixels of a given color. Since the phosphor elements of a pixel are located close together, the viewer observes them jointly rather than separately. The color which is experienced is a mixed color of the three elements. By exciting each element with a given intensity, the viewer experiences a given color. For example, when the red element and the blue element are excited to a strong extent and the green element is excited to a weak extent, the viewer will experience the mixed color of purple. Similarly as in a monochrome cathode ray tube, the pixels are located so close together that the viewer does not see them separately at a normal viewing distance. A color image is the result.

Known picture display devices have a considerable drawback. The electron gun has a too high operating temperature so that the lifetime is limited and the picture quality occurring during start-up of the picture display device is not optimal.

BRIEF SUMMARY OF THE INVENTION

It is, inter alia, an object of the invention to obviate the above-mentioned drawback. More particularly, it is an object of the invention to provide a picture display device in which the electron gun has a sufficiently low operating temperature so that the lifetime is extended and the picture quality during start-up of the picture display device is improved.

According to the invention, this object is achieved with a picture display device comprising a cathode ray tube with a tube base, which cathode ray tube comprises an electron gun with a cathode and electrostatic grids which are connected to glass rods, which picture display device is characterized in that the electron gun is provided with means enhancing the dissipation of heat produced by the cathode to the ambience. Due to the presence of these means, the heat released by the cathode is better dissipated. Consequently, the operating temperature of the electron gun (notably of the G1) will remain lower than in the case where the heat dissipation is not improved.

The picture display device is preferably provided with means enhancing heat dissipation, which means comprise a part having a surface losing heat due to radiation, which surface is not plane. The larger the effective radiating area of a surface, the more energy the surface can emit per unit of time. By giving the surface a rough area, for example by providing it with corrugations or by roughening it, the effective radiating surface is enlarged.

In accordance with a further preferred embodiment, the picture display device comprises a part having a surface with a high emission coefficient, or emissivity, in the wavelength range between 0.1 and 100 $\mu$m and preferably in the range between 1 and 40 $\mu$m. The higher the emissivity in this wavelength range, the more energy the part can emit per unit of time. The emissivity of a surface may be increased, for example, by blackening the surface, preferably by oxidizing it.

In accordance with a further preferred embodiment, the picture display device is provided with an electron gun whose grids have projections with an improved thermal conductivity. The heat radiated from the cathode can thereby be better dissipated towards the glass rods which have a satisfactory radiation.

In accordance with an advantageous embodiment, the projections clips of at least one of the electrostatic grids of the electron gun are connected to a pin in the tube base by means of a connection consisting of a material having a satisfactory thermal conductivity. The heat is thus extra dissipated via conduction.

In accordance with a further preferred embodiment, the picture display device is provided with semiconductor cathodes or field emitter cathodes. In a picture display device of this type, the advantages of the invention become particularly manifest. The cathodes present in these picture display devices reach a temperature during operation which is so high that the emissive surface of these cathodes is attacked thereby. This attack may consist of, for example the evaporation of a layer of material decreasing the work function, provided on that surface. The resultant problem is that the electron emission efficiency decreases. When the cathode has a very high temperature, for example when it is higher than 100° C. and certainly when it is higher than 130° C., the electron emission efficiency decreases at an unacceptable fast rate. The (emission) lifetime of the cathode is then insufficiently long to be acceptable. A sufficiently long lifetime of the cathode can be ensured by means of the measures according to the invention. As far as the non-optimum picture quality is concerned, which occurs during start-up of the picture display device, the inventors have realized that this is caused by thermal convergence drift. During start-up, the dimensions within the electron gun change due to the occurring change of temperature. As a result, an electron beam emitted by the electron gun does not land precisely on the desired location on the display screen.

The picture will then get fainter because the phosphor elements are not excited satisfactorily. In a color display tube, the picture may also be discolored because the three phosphor elements luminescing in different colors and constituting a pixel are not excited in the correct intensity ratio. The deviation from the desired location due to temperature effects is known as convergence drift. When the final temperature of the electron gun is lower, the maximally occurring thermal convergence drift is smaller. The maximum convergence drift can be limited by means of the measures according to the invention in such a way that the picture quality is acceptable during start-up.

In accordance with a further, favorable preferred embodiment, the picture display device is provided with thermionic cathodes. Here again, the advantages of the invention become particularly manifest. By using the invention, the picture quality and e lifetime of this type of cathode can be increased considerably.

BRIEF DESCRIPTION OF THE DRAWINGS

These and other aspects of the invention are apparent from and will be elucidated with reference to the embodiments described hereinafter.

In the drawings.

DETAILED DESCRIPTION OF THE INVENTION

Figure 1:
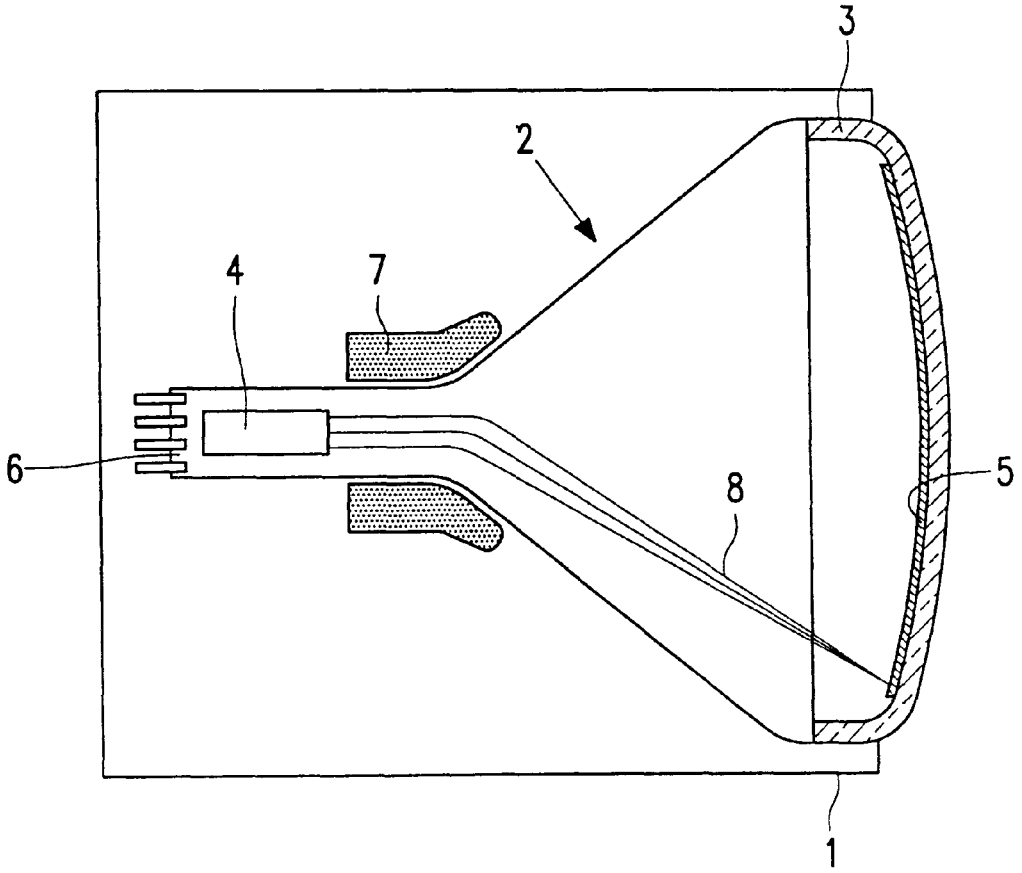
FIG. 1 is a diagrammatic cross-section of a picture display device.

FIG. 1 is a diagrammatic cross-section of a picture display device. A cabinet (1) accommodates a cathode ray tube (2). The cathode ray tube (2) has a glass envelope (3), (6) accommodating an electron gun (4) and a phosphor screen (5). The reference numeral (6) denotes the tube base. Deflection coils (7) surround the cathode ray tube. When the device is in operation, the electron gun (4) emits electrons which, if desired, are deflected by the deflection coils (7) whereafter they land on the desired location on the phosphor screen (5). One or more cathodes (not shown) are present in the electron gun. In a color display device, three electron beams are generated in operation. Reference numeral (8) denotes these three electron beams.

Figure 2:
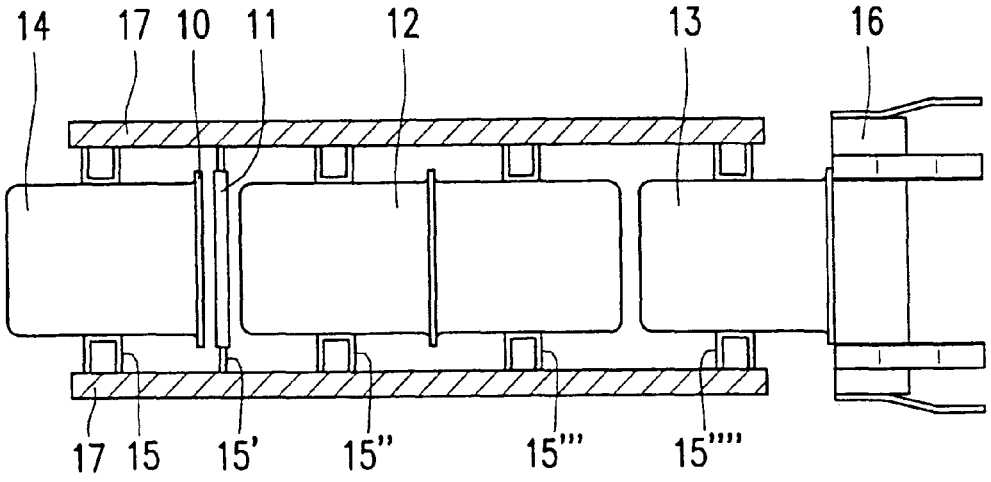
FIG. 2 is a diagrammatic cross-section of an electron gun.

FIG. 2 is a diagrammatic cross-section of an electron gun. An electron gun sends electron beams towards the screen of the picture display device. Such a gun comprises a plurality of electrostatic grids (10, 11, 12, 13). The first grid (10) is the G1 (grid 1) and has a skirt (14) accommodating one or more cathodes (not shown). The grids have projections (15, 15', 15", 15''', 15""). The electron gun also has a convergence cup (16). The projections of the electrostatic grids are pressed into glass rods (17) during the production process when these rods are still soft. After cooling of the rods (17) the grids (10, 11, 12, 13) have a fixed position relative to each other. The glass rods are connected to pins in the tube base. The electron gun of the picture display device is in vacuum. Hence, the dissipation of heat of the gun cannot be effected in the form heat transport by convection. Here, the energy is dissipated in the form of:

- heat propagating from the cathodes to the tube base by radiation and conduction
  - lateral radiation and conduction of the cathodes, to the skirt (14) further radiating and conducting the heat via projections
- upward radiation from the cathodes to the grids (10, 11, 12, 13) where this radiation is converted into heat and is then dissipated via the projections (15, 15', 15", 15''', 15"") to the glass rods (17) and via the connection of the glass rods (17) to the tube base.

The radiated power is dependent on the emission coefficient, or emissivity, $\epsilon$ of the material of the radiating surface. The normal skirt material has an emissivity $\epsilon$ of 0.15. By raising this emissivity, more heat can be dissipated via the skirt. The radiation via the glass rods is also an important way of dissipating heat. Particularly in electron guns, in which many components are integrated, a problem may arise. In fact, these electron guns have fewer projections in the glass rods so that there is less conduction towards these rods. However, integrated electron guns are relatively inexpensive. Thus, if a solution is found for the problem of heat dissipation, inexpensive integrated electron guns having a long lifetime can be produced.

Figure 3:
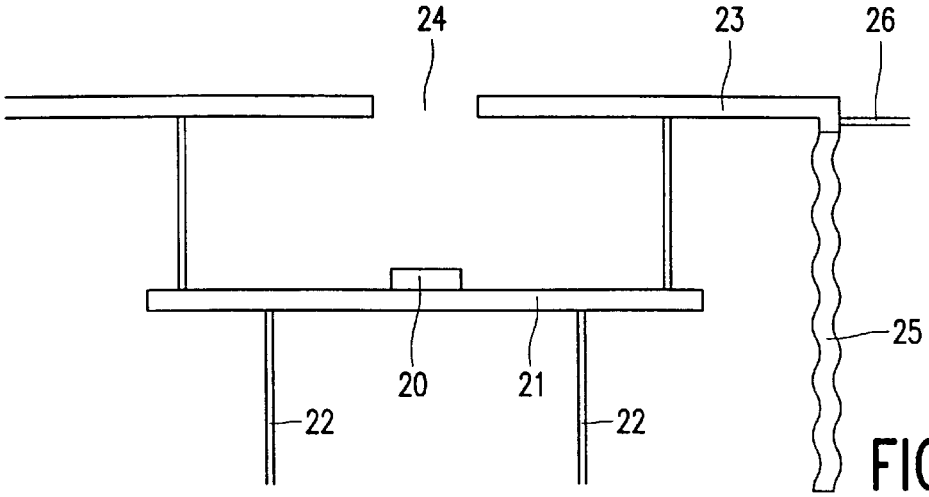
FIG. 3 is a diagrammatic cross-section of a part of an electron gun of a picture display device, provided with semiconductor cathodes.

FIG. 3 is a diagrammatic cross-section of a part of an electron gun in a picture display device according to the invention, provided with semiconductor cathodes. A layer of emissive material (20) is present on a support (21). The reference numeral (22) denotes the electric connections from the cathode to the tube base. The first grid (G1) (23) has an aperture (24) through which electrons emitted during operation by the cathode find their way to the further grid system of the electron gun. The first grid (23) has a skirt (25) and projections, one of which (26) is shown. An important type of semiconductor cathode is the AC cathode (avalanche cold cathode). The electron emission from layer (20) is made possible by a material decreasing the work function, provided on the layer (20). This material often consists of cesium. A problem is always not to lose this cesium. An important cause of cesium loss is thermal desorption. The desorption rate is higher as the operating temperature of the cathode is higher. In a picture display device with a cathode ray tube, an AC cathode may heat up to 180° C., inter alia, due to resistive heating under normal operating conditions. To limit the desorption rate to a reasonable level, the temperature should remain below 130° C. and preferably below 100° C. To this end, a part of the heat generated by the AC cathode must be dissipated.

As regards the non-optimal picture quality occurring during start-up of the picture display device, the following remarks will be made. During start-up, the dimensions within the electron gun change due to the occurring change of temperature. The different components of the electron gun expand. Consequently, an electron beam emitted by the electron gun does not land precisely on the desired location on the display screen. The deviation from the desired location (thermal convergence drift) changes during start-up. Initially, it increases and then decreases. The reason is that not all of the different components expand equally rapidly. It is ensured that, at the start-up, the deviation has such a negative value that the final value of the deviation is equal to zero. It is important that the maximally occurring convergence drift is not too large because otherwise not enough electrons excite the phosphors on the display screen per unit of time, so that the picture has a too low brightness. Discoloration of the picture also generally occurs in a color display device. The three cathodes for the three colors generally do not have the same convergence drift. The inventors have found that the maximally occurring thermal convergence drift is smaller when the electron gun has a lower final temperature. The maximum convergence drift can be limited by means of the measures according to the invention in such a way that the picture quality during start-up is still acceptable.

To enhance the dissipation of heat, different measures can be taken. For example, an enhanced thermal conductivity of the projections with which the G1 (23) is pressed into the glass rods may be ensured. Via the projections of the G1 (23), heat is dissipated towards the glass rods by means of conduction. The glass rods have an emissivity $\epsilon$ of 0.90. Thus they have a satisfactory radiation. The conductivity of the projections can be improved by using a different material or by making them thicker.

The heat dissipation can also be enhanced in a favorable manner by improving the radiation of the skirt (25) of the G1 (23). By conduction of heat from the AC cathode via the support (21) to the G1 (23), the skirt (25) of the G1 (23) is heated and radiates heat. The inventors have found that the heat radiation of the skirt (25) is enhanced by:

providing a relief in the skirt roughening the skirt surface using a material with a higher emissivity for the skirt.

The effective radiating surface is enlarged by means of the first two measures, so that more heat can be radiated per unit of time. Due to the higher emissivity, it can also be achieved by means of the second measure that more heat can be radiated per unit of time.

The relief in the skirt may be in the form of corrugations. FIG. 3 shows a part of an electron gun with a skirt having such corrugations. The radiation may also be enhanced by any extent of roughness of the surface. The root mean square of the roughness is, however, preferably smaller than 100 $\mu$m, otherwise the dimensional tolerance of the skirt is exceeded. The RMS is defined as follows:

$$<h_{rms}>=\sqrt{<h^2(x)>}$$

in which h(x) is the height of the surface relief as a function of the location on the surface. NiFe36 and NiFe42 (the figures indicate the nickel content) can be advantageously used for making a skirt having a sufficiently high emissivity in the wavelength range between 0.1 and 100 $\mu$m (in which energy is radiated). The emissivity in the wavelength range between 1 and 40 $\mu$m (in which most energy is radiated) is high enough to ensure an efficient dissipation of heat. The material NiFe36 has an extra advantage as compared with NiFe42 in that it oxidizes more easily than NiFe42 and can therefore be blackened in a standard process. This is the blackening process used for shadow masks. The emission factor may be raised from 0.15 to 0.6 by means of the changes in the skirt material. This means that 4 times as much heat can be radiated per unit of time.

Figure 4A:
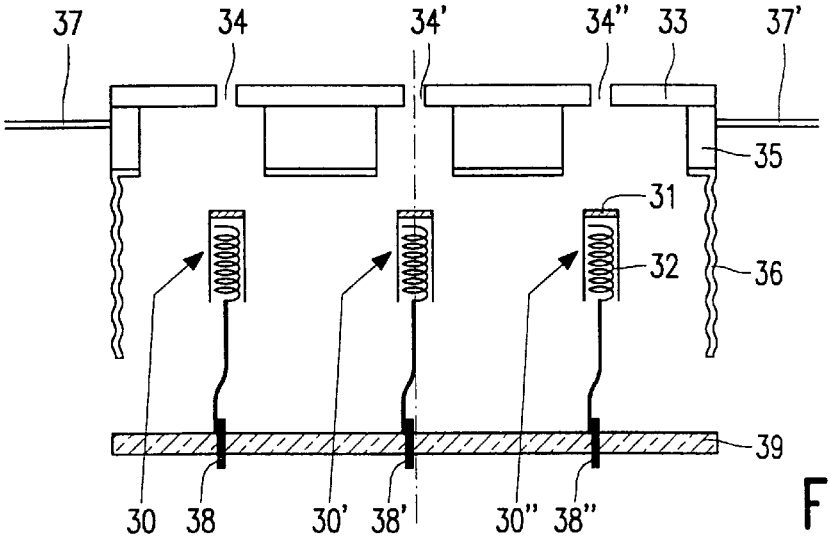
FIG. 4A is a diagrammatic cross-section of a part of an electron gun of a picture display device according to the invention, provided with thermionic cathodes.
Figure 4B:
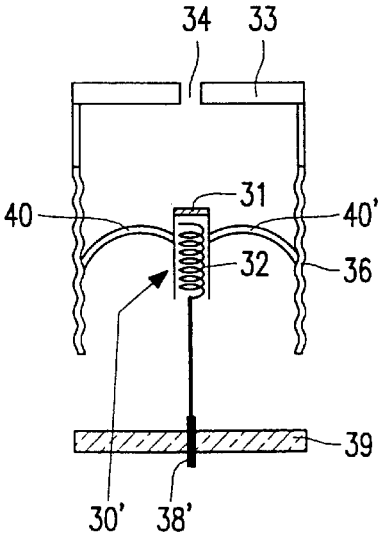
FIG. 4B is a diagrammatic cross-section through the part of the electron gun shown in FIG. 4A, taken on the broken line.

FIG. 4A is a diagrammatic cross-section of a part of an electron gun of a picture display device according to the invention, in an embodiment provided with thermionic cathodes. Each thermionic cathode (30, 30', 30") comprises a cap (31) and a filament (32). The first grid (G1) (33) has apertures (34, 34', 34") through which the electrons emitted in operation by the cathodes reach the further grid system of the electron gun. In this embodiment, the electron gun has a first sub-electrode (G1A) denoted by the reference numeral (35). The skirt is denoted by the reference numeral (36). Reference numerals (37, 37') denote the projections with which this part of the electron gun is secured. FIG. 4B is a diagrammatic cross-section through the part of the electron gun shown in FIG. 4A, taken on the broken line. The Figure shows how the cathode (30) is connected to the skirt (36) by means of straps (40, 40'). The filament (32) will have a temperature of approximately 1010° C. during operation. The cap (31) accommodates a material enhancing the electron emission. A color electron gun accommodates three cathodes of 0.65 W each, one for each color. The cathodes are situated under the skirt (36) of the gun and are connected to pins (38, 38', 38") in the tube base (39). The heat of the filament heats the cap (31), which enables electrons to be emitted. The decrease of temperature of the electron gun is also important in thermionic cathodes. Picture display devices comprising thermionic cathodes can get a longer lifetime when the electron gun has a lower operating temperature. The limitation of the maximally occurring convergence drift is extra important in electron guns with thermionic cathodes, because the distance between the cathode cap and the G1 in these electron guns may easily vary during start-up. The advantages of the invention become particularly manifest because the decrease of the operating temperature sufficiently limits the thermal convergence drift due to said change of dimensions, such that the picture quality during start-up is still acceptable. The temperature of the G1 (33) may be decreased by means of a better heat dissipation. This may be effected by using the measures as described with reference to FIG. 3. One of these measures, namely providing the skirt (36) with a relief, is shown in FIG. 4. The skirt (36) has a corrugated structure in this embodiment.

Figure 5A:
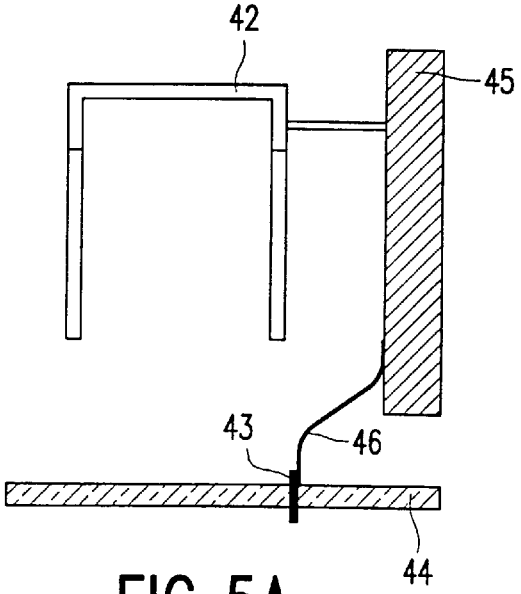
FIG. 5A is a diagrammatic cross-section of the G1 and the skirt with a conventional connection of the G1 to a pin in the tube base.
Figure 5B:
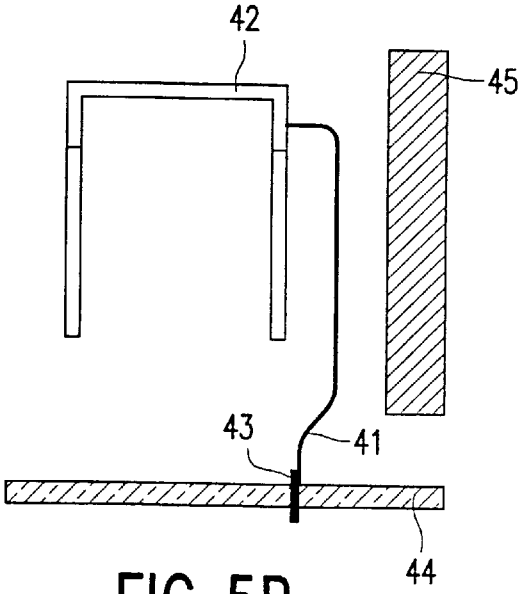
FIG. 5B is a diagrammatic cross-section of the G1 and the skirt with a direct connection of the G1 to a pin in the tube base.

FIG. 5B shows another measure which can be taken to enhance the dissipation of heat. By means of a direct connection (41) of the G1 (42) to a pin (43) in the tube base (44) with a material having a satisfactory thermal conductivity, heat can be dissipated in a very effective way. FIG. 5A shows how heat is usually dissipated by conduction via the glass rods (45) to the connection (46) of the glass rods (45) to a pin (43) in the tube base (44). However, the glass rods (45) have a fairly poor thermal conductivity. As a result, not much heat is dissipated in this way. This can be improved by means of a direct connection to a pin (43) in the tube base (44), as is shown in FIG. 5B.

The invention relates to a picture display device comprising an electron gun with cathodes having an enhanced dissipation of heat by virtue of an enlarged surface or an increase of the emissivity of the surface.

What is claimed is:

1. A picture display device comprising a cathode ray tube with a tube base, which cathode ray tube comprises an electron gun with a cathode and electrostatic grids which are connected to glass rods, characterized in that the electron gun includes at least one part having a corrugated surface which, during operation of the picture display device, loses heat due to radiation, thereby enhancing dissipation of heat produced by the cathode.

2. A picture display device comprising a cathode ray tube with a tube base, which cathode ray tube comprises an electron gun with a cathode and electrostatic grids which are connected to glass rods, characterized in that the electron gun includes at least one part having a roughened surface for, during operation of the picture display device, increasing heat radiation, thereby enhancing dissipation of heat produced by the cathode.

3. A picture display device comprising a cathode ray tube with a tube base, which cathode ray tube comprises an electron gun with a cathode and electrostatic grids which are connected to glass rods, characterized in that the electron gun includes at least one part having a surface with a heat radiation emissivity of more than 0.15 in the wavelength range between 0.1 and 100 $\mu$m.

4. A picture display device as claimed in claim 3, characterized in that the surface of the part is oxidized.

5. A picture display device comprising a cathode ray tube with a tube base, which cathode ray tube comprises an electron gun with a cathode and electrostatic grids which are connected to glass rods, characterized in that the electron gun includes at least one part having a surface with an emissivity of more than 0.15 in the wavelength range between 1 and 40 $\mu$m.

6. A picture display device comprising a cathode ray tube with a tube base, which cathode ray tube comprises an electron gun with a cathode and electrostatic grids which are connected to glass rods, characterized in that the electron gun includes at least one part having a direct connection between the electrostatic grid and a pin in the tube base, which connection is thermally conducting to provide the enhanced dissipation of heat.

* * * * *